US007685958B2

(12) United States Patent
Wulf

(10) Patent No.: US 7,685,958 B2
(45) Date of Patent: Mar. 30, 2010

(54) SHIP BOW

(75) Inventor: Udo Wulf, Klausdorf (DE)

(73) Assignee: New-Logistics GmbH, Goldenstedt (DE)

( * ) Notice: Subject to any disclaimer, the term of this patent is extended or adjusted under 35 U.S.C. 154(b) by 225 days.

(21) Appl. No.: 11/883,333

(22) PCT Filed: Sep. 28, 2005

(86) PCT No.: PCT/EP2005/010496

§ 371 (c)(1),
(2), (4) Date: Jul. 30, 2007

(87) PCT Pub. No.: WO2006/081846

PCT Pub. Date: Aug. 10, 2006

(65) Prior Publication Data

US 2009/0120347 A1 May 14, 2009

(30) Foreign Application Priority Data

Feb. 1, 2005 (DE) ..... 20 2005 001 574 U

(51) Int. Cl.
*B63B 1/32* (2006.01)

(52) U.S. Cl. ..... 114/288; 114/61.27

(58) Field of Classification Search ..... 114/61.1, 114/61.2, 61.27, 271, 288, 289, 290
See application file for complete search history.

(56) References Cited

U.S. PATENT DOCUMENTS 229,000 A * 6/1880 Kellogg ..... 114/288
1,712,281 A * 5/1929 Royer ..... 114/288
3,148,652 A * 9/1964 Canazzi ..... 114/290
3,937,164 A * 2/1976 Austin ..... 114/288
3,967,571 A * 7/1976 Mut ..... 114/288
5,570,649 A * 11/1996 Austin ..... 114/61.2
7,487,736 B2 * 2/2009 Daley ..... 114/271
2007/0032146 A1 2/2007 Wulf
2007/0266921 A1 * 11/2007 Brady ..... 114/288

FOREIGN PATENT DOCUMENTS

| | | |
|---|---|---|
| DE | 3712534 | 11/1988 |
| DE | 3838791 | 5/1990 |
| DE | 10343078.4 | 4/2005 |
| DE | 20 2004 020 606 | 10/2005 |
| JP | 58047689 | 3/1983 |

* cited by examiner

*Primary Examiner*—Lars A Olson
(74) *Attorney, Agent, or Firm*—Jacobson Holman PLLC

(57) ABSTRACT

The invention relates to a ship's bow with a central inclined plane area and starboard and port catamaran-like runners laterally thereto, the inclined plane area and runners in the midships direction pass roughly into a fictional keel line. The aim is to create such a ship's bow which, whilst being very economic when operating the ship can be used in modular manner for the most varied ship types and operating zones. To this end the runners are given a wedge-like construction and at the front runner end is provided a free flow attack opening for the inclined plane area, which is constructed with a specific inclination angle α.

10 Claims, 2 Drawing Sheets

SHIP BOW

CROSS-REFERENCE TO RELATED APPLICATIONS

This is a national stage of PCT/EP05/010496 filed Sep. 28, 2005 and published in German.

BACKGROUND OF THE INVENTION

1. Field of the Invention

The invention relates to a ship's bow having a central, slide-like inclined plane area and starboard and port catamaran-like runners provided laterally thereto, wherein the inclined plane area and runners pass in the midships direction roughly into a fictional keel line, the runners are wedge-shaped and in the midships direction have a maximum width, at the front runner end is provided a spacing A as a free flow attack opening for the inclined plane area and the inclined plane area has a main surface with an inclination angle $\alpha$ of approximately 10 to 25° relative to the fictional keel line.

2. Related Art

Such a ship's bow, which in modern ship building can also be used as a module, is suitable for different purposes, such as a container ship, a tanker ship or a general purpose ship and suchalike.

Ship's bows with comparable shapes are e.g. known from DE 29 28 634 B1, DE 38 38 791 A1 and DE 39 12 534 A1.

The ship's hull contour according to DE 29 28 634 B1 is e.g. designed with a three-keel shape. This contour leads to a loss of cargo space. It would scarcely be possible to implement the modular structure for different types of ship and the integration of an air bubble guide for reducing friction on the ship's bottom is scarcely feasible.

DE 38 38 791 A1 describes a ship's bow with two outer keel lines. The lower surface of the ship's hull is particularly suitable for sporting and yachting purposes. With regards to the use in freighters of any type, both with regards to the integration of modern drive systems and also a modular ship structure implementation possibilities are scarcely recognizable.

DE 37 12 534 A1 discloses a ship's hull with two lateral, catamaran-like float bodies and a vertically displaced central area. Said central area serves as a passage area for water to the roughly centrally positioned propeller.

As a result of the central area running over the entire ship's length, the disadvantage of unusable cargo volume is deliberately accepted. Therefore a modular change to the ship's bow is only suitable for the type of ships specifically described in this prior art.

In the case of the ship's bow described in DE 103 43 078.4, the design is specifically for propulsion units housed in the forward part of the ship and improvements to the fundamental design of the hydrodynamic shaping would appear possible.

The above-described shapes of ship's bows are therefore in part not usable in modular manner for different cargo ships.

A further ship's hull is known from JP 58047689. This known hull has two projecting stem structures between which is provided an inclined plane.

SUMMARY OF THE INVENTION

Thus, the object of the invention is to provide a ship's bow which, in the case of good economics in the operation of the ship, can be used in modular manner in the most varied types of ship and shipping areas, such as shallow or deep water areas.

According to the invention this object is achieved with a ship's bow having a central, slide-like inclined plane area and starboard and port catamaran-like runners provided laterally thereto, wherein the inclined plane area and runners pass in the midships direction roughly into a fictional keel line, the runners are wedge-shaped and in the midships direction have a maximum width, at the front runner end is provided a spacing A as a free flow attack opening for the inclined plane area and the inclined plane area has a main surface with an inclination angle $\alpha$ of approximately 10 to 25° relative to the fictional keel line, wherein the inclined plane area has between the runners in the forwards direction an-other area arranged at an angle $\psi$ of approximately 1 to 20° to the main surface in the upwards direction.

A fundamental idea of the invention is to provide a semi-catamaran-like ship's bow with a central, slide-like (that is, smooth) inclined plane structure. The semicatamaran structure is abandoned at the transition to the central ship's area, i.e. after the bow area, in order to acquire maximum cargo space. On the other hand, the inclined plane contour is created in its path from the lowermost fictional keel line to the topmost bow area with an inclined plane passing continuously into a lower and an upper transition area, which cause the waves drawn-in in the bow area to slide in propulsion-efficient manner under the ship's bottom.

The main surface of the inclined plane area is advantageously located with an inclination angle of approximately 10 to 25° with respect to the fictional keel line and passes in a large arc radius of approximately 10 to 40 m into the ship's bottom or into the furthest forward bow area. The inclined plane approximately has a petering-out wedge shape, so that a damming effect of impacting waves is largely avoided and there would also appear to be suitability for travelling through ice.

The catamaran-like, outer runners (that is, outer runners that are elongated and buoyant) are provided port and starboard in the manner of upright wedges and have a maximum free spacing A at the bow stem.

The runner structure is preferably linear to the midships axis and optionally also strictly parallel to the midships axis. The outer contour of the runners is configured from the front wedge tip in arcuate manner to a maximum width and a central tangential line at the outer contour appropriately has an angle $\lambda$ in the range approximately 6 to 20°. This angle can also be roughly 30° at the wedge tip. The total width B of the bow or the ship is in a ratio to spacing A dependent on the intended use and design of the ship. This ratio is preferably chosen in a range of 1.5 to 3.5.

As a function of the installation of propulsion units in the fore part of the ship and in coordination with possible devices for reducing friction at the ship's bottom, for hydrodynamic improvement purposes the inner surfaces of the runners can be at an angle $\beta$ of approximately −5° to +5° to the parallel to the longitudinal axis or midships axis of the ship placed through the runner tip.

The inventive ship's bow can be used as a module in the most varied ship types such as container, tanker or bulk carrier ships or suchalike and is also suitable for widely varying ship sizes. The optimum suitability for inland waters and for coastal and deep sea waters have been confirmed by test results on a model.

The advantageous, roughly perpendicular path of the stem of the runners gives, together with the central inclined plane contour, a draw-in area for impacting waves in the case of a front opening area A, which is also suitable for air bubble lubrication on the inclined plane and ship's bottom.

The ship's bow is particularly suitable for travelling in shallow waters, particularly inland waters, at a relatively high speed and as a result of the hydrodynamic structure even at higher speeds the formation of higher waves is reduced and good economic effectiveness achieved.

BRIEF DESCRIPTION OF THE DRAWINGS

The invention is described in even greater detail hereinafter relative to an embodiment, wherein show.

DETAILED DESCRIPTION OF THE PREFERRED EMBODIMENTS

Figure 1:
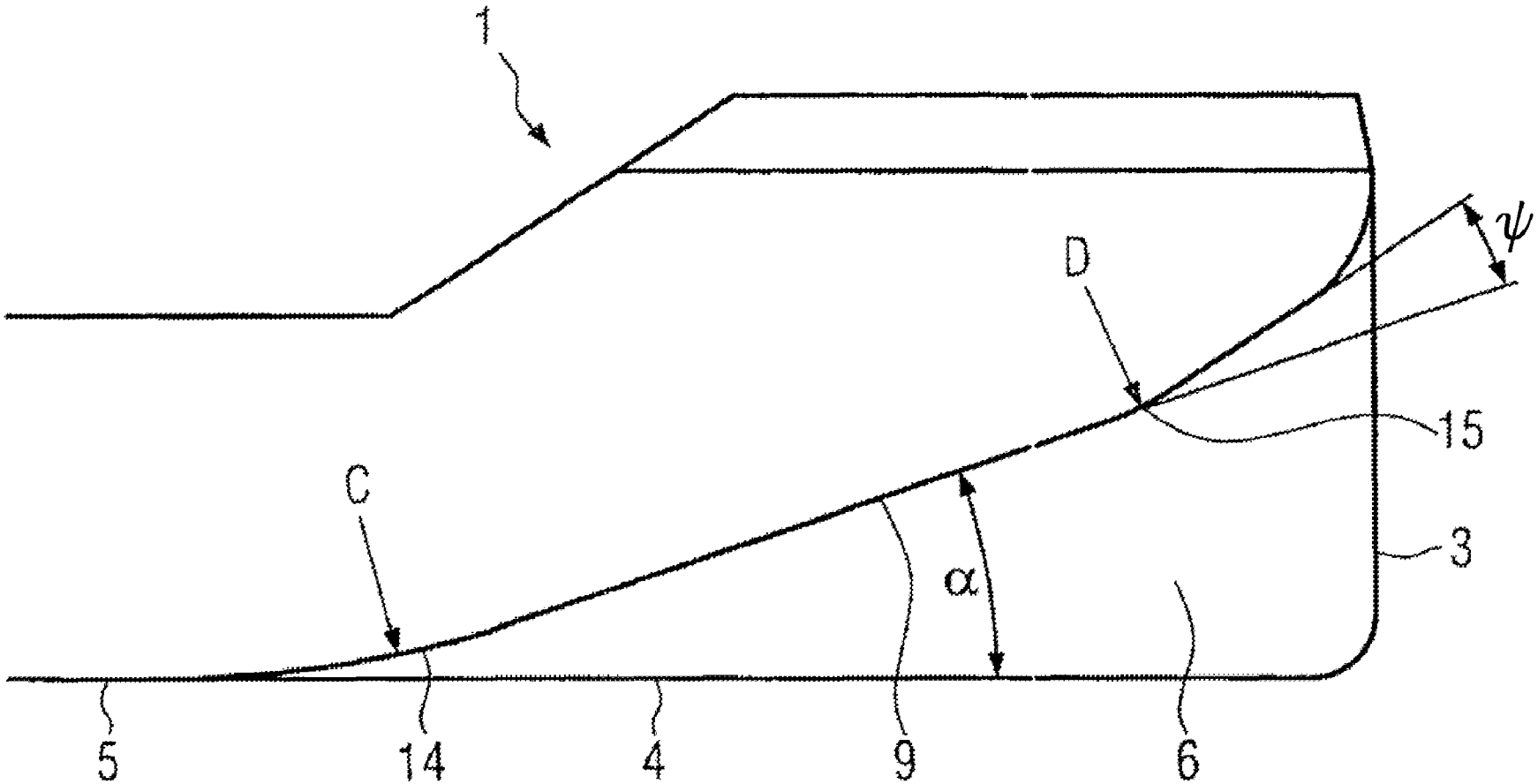
FIG. 1 A vertical section through a ship's bow in the region of the midships axis.

FIG. 1 shows a ship's bow 1 with a modular character in sectional representation along midships axis 30. The stem 3 of a port, upright runner 6 has a largely perpendicularly directed, front wedge tip. The lowermost area of the ship's bow 1 runs along a fictional keel line 4 indicating the ship's bottom 5 in direction towards midships.

Symmetrically to the midships line 30, between the outer runners 6, 7 is provided a slide-like inclined plane area 9, which is roughly at an angle $\alpha$ of 10 to 25° to the fictional keel line 4. According to FIG. 1 this inclined plane area 9 passes arcuately with a large radius C in transition area 14 into ship's bottom 5. Radius C can be approximately 10 to 45 m and preferably up to 40 m.

In a similar manner in the front area of inclined plane 9 there is an arcuate upward transition area 15 with a radius D of approximately 10 to 30 m. The area connecting forwards to the transition area 15 appropriately runs under an angle $\psi$ of 1 to 20° in the direction of the stem 3.

Figure 2:
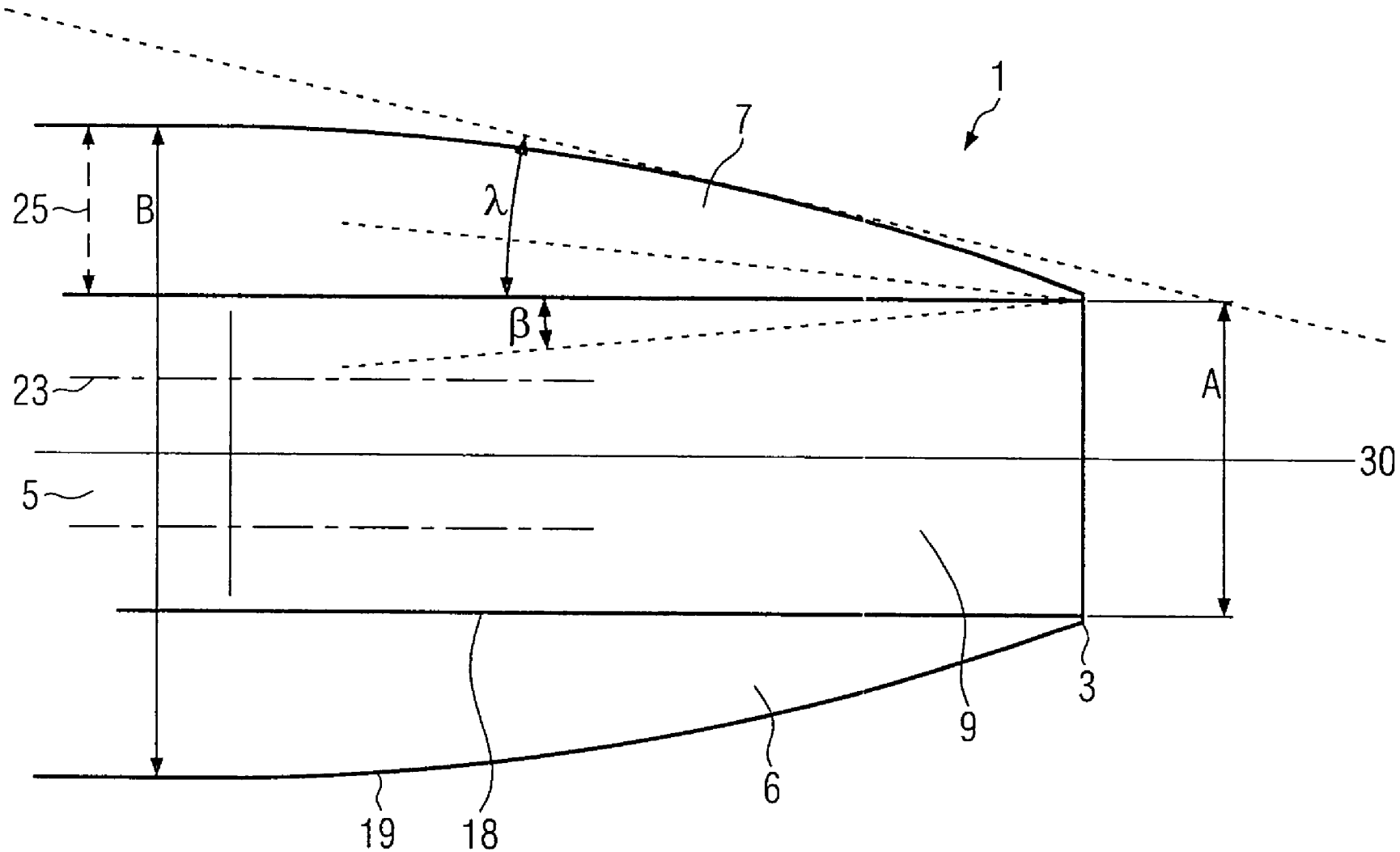
FIG. 2 A view of the bottom area of the ship's bow module according to FIG. 1 with essential details concerning the geometrical shape of the bow.

The view of the bottom side in FIG. 2 shows the runners 6, 7 with a linear surface or inner line 18 and an arcuate outer contour 19 up to a maximum width 25. Between the tips of runners 6, 7, there is a spacing A as the inflow opening for bow-side water at the stem.

The free spacing A is kept appropriately constant as an internal spacing between runners 6, 7 in the bow area.

For improving the flow behaviour changes in accordance with specific circumstances, such as the drive technology in the prow area, etc. and an arrangement of the inner lines 18 at an angle $\beta$ of +/−5° to the parallel of the midships axis 30 are possible.

In the case of an air bubble introduction device reducing friction on the ship's bottom, already in the inclined plane area 9 can be provided longitudinal webs 23 with a limited height of approximately 2 to 3 cm for the better guidance of the air bubble mist.

The average angle $\lambda$ as a tangential angle at the arcuate outer contour 19 of a runner 17 is approximately 6 to 20°. This angle is greater at the wedge tip 3 and can be approximately 30°.

In model tests a ratio of the maximum total width B of bow 1 to the spacing A has proved particularly efficient with a range 1.5 to 3.5. Variations therefrom with a view to specific overall design of the ship's body, driving power and deadweight capacity are conceivable.

The essential geometric data of the inventive ship's bow can in approximate manner be gathered from the ratio shown in FIGS. 1 and 2. Fundamentally said ship's bow is usable for different types of ship and waters and for the most varied drive units and optionally even for travelling through ice.

The invention claimed is:

1. Ship's bow comprising:

a central, smooth, inclined plane area and starboard and port, elongated and buoyant runners provided laterally thereto, wherein the inclined plane area and the runners pass in the midships direction roughly into a fictional keel line, the runners are wedge-shaped and in the midships direction have a maximum width, at a front runner end is provided a spacing A as a free flow attack opening for the inclined plane area, and the inclined plane area has a main surface with an inclination angle $\alpha$ of approximately 10 to 25° relative to the fictional keel line, wherein the inclined plane area has between the runners in the forwards direction another area arranged at an angle $\psi$ of approximately 1 to 20° to the main surface in the upwards direction.

2. Ship's bow according to claim 1, wherein, in horizontal section, the runners have a linear inner line or inner surface, which is roughly parallel to a midships line or is under an angle $\beta$ in the range −5° to +5° to a parallel midships line and wherein an outer line of the runners is essentially under an angle $\lambda$ to the parallel midships line, $\lambda$ being in the range approximately 6 to 20°.

3. Ship's bow according to claim 2, wherein the runners have an arcuate outer contour.

4. Ship's bow according to claim 1, wherein a ratio V of a maximum total width B of the ship's bow to the spacing A is chosen in the range 1.5 to approximately 3.5.

5. Ship's bow according to claim 1, wherein the inclined plane area in the midships direction passes continuously with a large arcuate structure into the fictional keel line or ship's bottom, and wherein the front bow area has an arcuate transition with a radius D of approximately 10 to 30 m.

6. Ship's bow according to claim 5, wherein the inclined plane area in the midships direction passes continuously with a radius C of approximately 10 to 45 m into the fictional keel line or ship's bottom.

7. Ship's bow according to claim 1, wherein the inner spacing A of the runners is constant and the outer contour of the runners passes in continuous arcuate manner from the wedge tip to the maximum width.

8. Ship's bow according to claim 1, wherein:

in horizontal section, the runners have a linear inner line or inner surface, which is roughly parallel to a midships line or is under an angle $\beta$ in the range −5° to +5° to a parallel midships line and wherein an outer line of the runners is essentially under an angle $\lambda$ to the parallel midships line, $\lambda$ being in the range approximately 6 to 20°, a ratio V of a maximum total width B of the ship's bow to the spacing A is chosen in the range 1.5 to approximately 3.5, the inclined plane area in the midships direction passes continuously with a radius C of approximately 10 to 45 m into the fictional keel line or ship's bottom, the front bow area has an arcuate transition with a radius D of approximately 10 to 30 m, and the inner spacing A of the runners is constant and the outer contour of the runners passes in continuous arcuate manner from the wedge tip to the maximum width.

9. Ship's bow according to claim 1, further comprising longitudinal webs of limited height provided in the inclined plane area and outer lateral area of the ship's bottom for guiding air bubbles.

10. Ship's bow according to claim 9, wherein the longitudinal webs have a height of 2 to 3 cm.

* * * * *